US005505682A

United States Patent [19]

Shimizu

[11] Patent Number: 5,505,682

[45] Date of Patent: Apr. 9, 1996

[54] COLD ROLLING WORK ROLL

[75] Inventor: Shigeki Shimizu, Fujisawa, Japan

[73] Assignee: Kanto Special Steel Works, Ltd., Kanagawa, Japan

[21] Appl. No.: 508,316

[22] Filed: Jul. 27, 1995

Related U.S. Application Data

[63] Continuation of Ser. No. 251,948, Jun. 1, 1994, abandoned.

[30] Foreign Application Priority Data

Dec. 27, 1993 [JP] Japan ..... 5-330961

[51] Int. Cl.[6] ..... C22C 38/12

[52] U.S. Cl. ..... 492/58; 492/54

[58] Field of Search ..... 492/54, 58

[56] References Cited

U.S. PATENT DOCUMENTS

| | | | |
|---|---|---|---|
| 4,191,599 | 3/1980 | Stickels et al. | 492/58 |
| 4,484,959 | 11/1984 | Boucher et al. | 148/127 |
| 5,225,007 | 7/1993 | Hattori et al. | 492/58 |

FOREIGN PATENT DOCUMENTS

| | | | |
|---|---|---|---|
| 55-100965 | 8/1980 | Japan . | |
| 6020145 | 2/1981 | Japan | 492/54 |
| 7101645 | 6/1982 | Japan | 492/54 |
| 055550 | 4/1983 | Japan | 492/54 |
| 1023507 | 2/1986 | Japan | 492/54 |
| 1147815 | 7/1986 | Japan | 492/54 |
| 1104750 | 4/1989 | Japan . | |
| 3165906 | 7/1991 | Japan | 492/58 |

*Primary Examiner*—Irene Cuda
*Attorney, Agent, or Firm*—Sughrue, Mion, Zinn, Macpeak & Seas

[57] ABSTRACT

A cold rolling work roll having improved grindability is made from forged steel of a composition consisting, by weight, essentially of:

C: 0.70–1.20%, Si: 0.15–1.00%, Mn: 0.15–1.00%,
Cr: 1.5–5.5%, Mo: not mroe than 0.60%,
Ti: up to 0.0029%, V: 0.1–0.49%,
Ni: 0–1.0%, Fe and incidental impurities: balance. Preferably the maximum particle size of the carbides is adjusted to be no more than 1.50 μm.

12 Claims, No Drawings

COLD ROLLING WORK ROLL

This is a Continuation of application Ser. No. 08/251,948 filed Jun. 1, 1994, now abandoned.

BACKGROUND OF THE INVENTION

The present invention relates to a work roll for use in the cold rolling of metals, and particularly to a quenched roll that is made of forged steel and has high grindability.

For the cold rolling of steel strips and aluminum plates, there have conventionally been used quenched work rolls made of forged steel that comprise by weight, 0.75–1.20% C, 2–5% Cr and 0.15–0.55% Mo, with Ni and V being optionally added in amounts not exceeding 2% and 0.5%, respectively (see Unexamined Published Japanese Patent Application (kokai) No. 55-100965/1980).

With the increasing requirements that have to be satisfied as to the surface properties of workpieces to be cold rolled in modern mills, the grindability of the work roll used in the rolling operation has become an extremely important factor. Stated briefly, the surfaces of work rolls that have been ground under specified conditions are required not only to be within specified roughness ranges but also to contain less than specified numbers of scratches and microscopic point flaws.

These requirements cannot be fully met by rolls having the compositional ranges specified in Unexamined Published Japanese Patent Application (kokai) No. 55-100965/1980 since it is difficult to suppress the development of scratches, as well as to finish-work the rolls to a specified roughness range in a consistent manner. In fact, neither attempting to alter the grinding conditions nor that to depend entirely upon the skill and expertise of grinding personnel has been satisfactory.

A proposal has therefore been made that these problems be solved by redesigning the material of the work roll to be used (see Unexamined Published Japanese Patent Application (kokai) No. 1-104750). A roll having the compositional ranges specified by this proposal satisfies most of the requirements for better grindability. However, the result is not completely satisfactory in areas where fine scratches caused by the grinding operation can be a serious problem, as exemplified by the cold rolling of aluminum which is to be used as a material for making presensitized offset plates. Hence, a technique that can achieve a complete improvement in this aspect has long been desired.

SUMMARY OF THE INVENTION

An object of the present invention is to solve the aforementioned problems of the prior art by providing a cold rolling work roll having improved grindability.

With a view to improving the grindability of rolls, various attempts have heretofore been made in three aspects, i.e., the material of rolls, the method of their manufacture and the grinding technology. However, no one has ever succeeded in proposing complete solutions that insure reproducible results.

Under the circumstances, the present inventors, desiring to attain the above object, conducted research on various factors in the material of rolls that might affect their grindability. They learned that the grindability of rolls, particularly the roughness caused by grinding and the development of scratches from grinding were greatly influenced by the amount of titanium carbo-nitride in the roll, as well as by the composition and morphology of the carbides that were incorporated in the microstructure of the roll.

The present inventors then found that the grindability of the roll could be improved markedly and consistently by controlling the titanium and vanadium contents of the roll, and controlling the morphology of carbides in its microstructure.

According to one aspect, the present invention provides a highly grindable forged steel work roll for cold rolling with a steel composition consisting, by weight, essentially of:

0.70–1.20% C;
0.15–1.00% Si;
0.15–1.00% Mn;
1.5–5.5% Cr;
not greater than 0.60% Mo;
not greater than 0.0029% Ti;
0.10–0.49% V;
0–1.0% Ni; and
a balance of iron and incidental impurities.

According to another aspect, the present invention provides a highly grindable forged steel work roll for cold rolling with a steel composition consisting, by weight, essentially of:

0.70–1.20% C;
0.15–1.00% Si;
0.15–1.00% Mn;
1.5–5.5% Cr;
not greater than 0.60% Mo;
not greater than 0.0029% Ti;
0.10–0.49% V;
0–1.0% Ni; and
a balance of iron and incidental impurities;
wherein the carbides comprising the microstructure have a maximum particle size not greater than 1.50 μm.

DESCRIPTION OF THE PREFERRED EMBODIMENTS

The operational effects of steel composition and microstructure on the grindability of the work roll of the present invention will first be described.

Most of the scratches that will develop on a work roll in the grinding process are formed by the dislodging of abrasive particles, and they will develop in different ways depending upon the roll material even if the grinding conditions are essentially the same.

The following two observations can be made with respect to the relationship between scratches and roughness on the one hand and the chemical composition and microstructure of the roll on the other.

(1) By controlling the upper limit of the titanium content of the roll, its grindability will indeed be improved in terms of increased ease in finishing the roll surface to a specified roughness. On the other hand, the load on each abrasive particle will increase during the grinding operation. As a result, the dislodging of abrasive particles will be accelerated, increasing the chance of the development of scratches.

(2) The profile of the distribution of the chromium carbide which are present in the microstructure of the roll, and particularly the maximum particle size of those residual carbides will also affect the development of scratches from the dislodging of abrasive particles. More specifically, the larger the maximum particle size of the residual carbides and the less uniform their distribution is, the greater is the chance of the development of scratches.

Therefore, in the present invention, the grindability of the roll, which means its ability to suppress the development of scratches due to the dislodging of abrasive particles during the grinding operation while assuring surface roughness within a specified range, is improved by limiting the chemical composition of the roll to the ranges specified herein, preferably in combination with the limitation on the maximum particle size of the carbides in the microstructure of the roll.

The technical rationale of above observations (1) and (2) is described below more specifically.

Observation (1) concerns the content of titanium carbonitride in the roll. Because of its high hardness value, titanium carbo-nitride will accelerate the shedding and the loading of abrasive particles during the grinding operation, thus making it difficult to assure the necessary surface roughness of the roll. Hence, the content of titanium carbonitride in the roll is preferably kept as small as possible. However, if its content is too small, the development of scratches is accelerated due to the dislodging of abrasive particles for the reason already described above. Therefore, observation (1) states that it is effective to add some elements in amounts within such a range that the necessary surface roughness is insured while suppressing the dislodging of abrasive particles.

Observation (2) concerns the residual carbides in the microstructure of the roll. Like the titanium carbo-nitride, the residual carbides have high hardness compared to the base martensite structure. Therefore, the residual carbides also have the ability to accelerate the shedding and the loading of abrasive particles during the grinding operation. However, the surface roughness as achieved by the grinding operation is affected by the residual carbides to a smaller degree than by the titanium carbo-nitride. Nevertheless, the residual carbides do affect the dislodging of abrasive particles.

The criticality of the above-specified ranges of the elements in roll steel composition of the present invention is described below together with the intended functions of the respective elements. Throughout the specification, all "percents" are on a weight basis.

To begin with, the criticality of the composition of the work roll of the present invention is set forth below. C:

Carbon is the most important element for the hardenability of steel. It is also important in that it binds to Cr (see below) to form a carbide, thereby imparting wear resistance. If the amount of C is less than 0.70%, the hardness necessary for use as a work roll is not attained. If the amount of C exceeds 1.2%, the distribution of the carbide becomes uneven, lowering the toughness of the roll, and its grindability. Therefore, carbon should be added in amounts ranging from 0.70 to 1.2%, preferably 0.75–0.95%. Si, Mn:

Silicon and manganese must each be present in an amount of at least 0.15% as a deoxidizer and a hardenability improving element, respectively, in the steelmaking process. However, if they are added in excessive amounts, the cleanliness of the steel will be impaired. Therefore, neither element should exceed the upper limit of 1.0%.

Cr:

Chromium is a carbide forming element, and it is also effective in improving hardenability. If the amount of Cr is less than 1.5%, it will not exhibit the intended effect. On the other hand, if the amount of Cr exceeds 5.5%, the distribution of the carbide becomes uneven, impairing the grindability of the roll. Therefore, the upper limit of the amount of Cr is 5.5%. Preferably, Cr is added in amounts ranging from 2.5–5.0%.

Mo:

Molybdenum is effective in improving hardenability. If its amount exceeds 0.60%, not only is the grindability of the roll impaired but also cost becomes a problem. Therefore, the upper limit for the amount of Mo is 0.60%. Preferably, 0.20%–0.50% of Mo is added.

Ti:

Titanium, like vanadium, is a very important element for the purpose of the present invention. Excessive presence of Ti contributes to the formation of a very hard titanium carbonitride which lowers the grindability of the roll, in particular, its roughness from grinding. If, on the other hand, Ti is present in an unduly small amount, the grindability of the roll becomes excessive and, as mentioned hereinabove, the development of scratches is accelerated by the dislodging of abrasive particles.

In the present invention, the upper limit for the addition of Ti is 0.0029% in order to assure the necessary surface roughness and the smaller the better. On the other hand, the potential development of scratches due to the presence of Ti in such a restricted, small amount can be suppressed by the addition of V as described just below. Preferably, the upper limit of Ti is 0.0020%.

V:

As mentioned above, vanadium, like titanium, is a very crucial element for the purpose of the present invention It is generally regarded as an element that is effective in grain-refining and improving hardenability. In cold rolling work rolls of the type targeted by the present invention for which good grindability is an important consideration, vanadium has not been used as a compositional element in general in order to insure satisfactory grindability.

In the present invention, the content of V is specified in close association with the above-mentioned Ti content. In the case where the Ti content is no more than 0.0029%, adding less than 0.10% of V is not desirable since scratches will develop due to the dislodging of abrasive grains. If, on the other hand, the content of V exceeds 0.49%, the necessary surface roughness will not be attained. Therefore, V is added in amounts ranging from 0.10 to 0.49%. The preferred range is from 0.15 to 0.35%.

Ni:

Nickel, which is an element effective in improving hardenability, is optionally added in the present invention. If it is added excessively, the spheroidization of the carbide is impaired and the necessary hardness for a cold rolling work roll cannot be attained. Therefore, the upper limit of Ni, if it is added, is 1.0%.

In the present invention, the maximum particle size of the residual carbides is preferably limited as set forth hereinabove. The criticality of this limitation is described below.

The work roll of the present invention is manufactured by the following procedure. First, a steel having the composition set forth hereinabove is melted, typically in an electric furnace. Then, the steel is formed into a roll stock by electro-slag remelting. The stock is forged into a roll typically having a diameter of 250–700 mm. The forged roll is subjected to final heat treatment consisting of quenching and tempering.

The cold rolling work roll has such a final structure that the cold tempered martensite matrix contains a small amount (no more than 10%) of fine and dispersed residual carbides that are chiefly composed of chromium carbide.

As already mentioned, the residual carbides which are harder than the base martensite structure will accelerate the dislodging of abrasive particles during grinding. This accelerating action becomes marked as the carbides are composed of coarser grains and as they are distributed less evenly. According to studies conducted by the present inventors, the accelerating action becomes harmful if the maximum particle size of the carbides exceeds 1.50 μm. Preferably, the maximum particle size of the carbides is adjusted to be no more than 0.80 μm. Given the same steel composition, the maximum particle size of the carbides can be controlled by varying the heat treatment conditions of annealing, normalizing, and quenching.

A work roll having good grindability can be obtained simply by limiting the Ti and V contents to the range specified herein. However, the effectiveness of the present invention can be further enhanced by adjusting the maximum particle size of the carbides to no more than 1.50 μm, and preferably no more than 0.80 μm.

The term "carbides" as used herein means ones that are chiefly composed of Cr carbide. Specifically, it refers to a Cr carbide that may sometimes also contain Fe, Mo and V carbides. In this connection, it is interesting to note that Ti carbo-nitride particles are shaped like polygons with straight sides having a size of up to about 10 μm.

The present invention is described more specifically with reference to examples, which are given for illustrative purposes only.

EXAMPLE 1

This example shows the criticality of the addition of appropriate amounts of Ti and V to the steel as well as of controlling morphology of the carbides in the microstructure of the roll.

Mini-rolls having a diameter of 200 mm were prepared from the steel compositions shown in Table 1. The rolls were ground under given conditions and evaluated for surface roughness and the development of scratches. The results are shown in Table 2.

Thus, it can be seen that the surface roughness of the roll attained by grinding under given conditions is influenced primarily by the Ti and V contents of the roll. The lower the contents of these elements, the rougher is the roll surface.

The occurrence of scratches is influenced primarily by the Ti content of the roll and the maximum particle size of the residual carbides. The lower the Ti content and the greater the maximum particle size of the residual carbides, the more frequently will scratches occur. Comparing these two factors, the Ti content is more influential than the maximum particle size.

These results show that by limiting the V and Ti contents of the roll and the maximum particle size of the residual carbides in its microstructure to optimal ranges, rolls can be manufactured that have good grindability as evidenced by the ease in achieving appropriate surface roughness and the development of very few scratches.

It is therefore clear that the problems of the prior art in connection with the grindability of work rolls can be solved by limiting the chemical composition of the steel used for rolls and controlling the morphology of carbides in its microstructure to lie within such ranges that the necessary surface roughness can be attained while effectively suppressing the dislodging of abrasive grains.

EXAMPLE 2

In this example, forged steel work rolls for use in the cold rolling of aluminum sheet used for presensitized offset plates, for which particularly good grindability is required, were manufactured from the steel composition in Table 3. The thus manufactured rolls were subjected to the same grinding test as in Example 1.

The test results are also shown in Table 3. It can be seen that all the test rolls had good grindability, since the intended surface roughness could be attained for each roll without developing an unacceptably large number of scratches.

As described above, the present invention enables the grindability of cold rolling work rolls to be improved in an easy and consistent manner.

TABLE 1

| | (Hardness, HS: 95–100) | | | | | | | | | |
|---|---|---|---|---|---|---|---|---|---|---|
| Roll No. | C | Si | Mn | Ni | Cr | Mo | V | Ti | Maximum particle size of carbides (μm) | Remarks |
| 1 | 0.81 | 0.32 | 0.26 | — | 3.32 | 0.28 | 0.16 | 0.0005 | 0.72 | Invention |
| 2 | 0.86 | 0.36 | 0.33 | 0.46 | 3.10 | 0.26 | 0.20 | 0.0024 | 0.96 | Invention |
| 3 | 0.92 | 0.42 | 0.26 | 0.23 | 4.36 | 0.29 | 0.25 | 0.0073 | 0.72 | Comparison |
| 4 | 0.85 | 0.33 | 0.36 | 0.20 | 3.34 | 0.26 | 0.40 | 0.0125 | 1.12 | Comparison |
| 5 | 0.89 | 0.40 | 0.25 | 0.16 | 3.07 | 0.56 | — | 0.0005 | 0.72 | Comparison |
| 6 | 0.86 | 0.30 | 0.30 | 0.14 | 4.20 | 0.23 | — | 0.0010 | 1.12 | Comparison |
| 7 | 0.84 | 0.27 | 0.29 | 0.20 | 3.48 | 0.25 | 0.52 | 0.0050 | 0.75 | Comparison |
| 8 | 0.86 | 0.32 | 0.36 | 0.58 | 2.83 | 0.16 | 0.60 | 0.0068 | 1.20 | Comparison |

TABLE 2

| Roll | Grinding (#180 grinding wheel) | | |
|---|---|---|---|
| No. | roughness *1 | scratches *2 | Rating |
| 1 | ○ | ◎ | good |
| 2 | ○ | ○ | good |
| 3 | S | ○ | no good |
| 4 | S | X | no good |
| 5 | L | X | no good |
| 6 | L | X | no good |
| 7 | S | X | no good |
| 8 | S | X | no good |

*1 ○: appropriate, S: too small, L: too large
*2 ◎: very few, ○: a few, X: many(not acceptable)

TABLE 3

| Roll No. | Roll diameter (mm) | C | Si | Mn | Ni | Cr | Mo | V | Ti | Maximum particle size of carbides (μm) | Roughness *1 | Scratches *2 |
|---|---|---|---|---|---|---|---|---|---|---|---|---|
| 9 | 422 | 0.82 | 0.27 | 0.35 | 0.14 | 3.27 | 0.27 | 0.25 | 0.0020 | 0.70 | ○ | ◎ |
| 10 | 532 | 0.85 | 0.28 | 0.30 | 0.14 | 3.34 | 0.29 | 0.18 | 0.0010 | 0.70 | ○ | ◎ |
| 11 | 585 | 0.91 | 0.34 | 0.30 | 0.52 | 4.23 | 0.29 | 0.16 | 0.0008 | 0.85 | ○ | ○ |

*1 ○: appropriate,
*2 ◎: very few, ○: a few

What is claimed is:

1. A cold rolling, forged steel work roll having high grindability, the work roll having a steel composition that consists, by weight, essentially of:

C: 0.70–1.20%, Si: 0.15–1.00%, Mn: 015–100%,

Cr: 1.5–5.5%, Mo: not greater than 0.60%,

Ti: is present, in a content not greater than 0.0029%,

V: 0.10–0.49%

Ni: 0–1.0%

Fe and incidental impurities: balance.

2. A cold rolling work roll as set forth in claim 1 wherein the carbon content is 0.75–0.95%.

3. A cold rolling work roll as set forth in claim 1 wherein the chromium content is 2.5–5.0%.

4. A cold rolling work roll as set forth in claim 1 wherein nickel is present, in a content of 1.0% or less.

5. A cold rolling work roll as set forth in claim 1, wherein the vanadium content is 0.16–0.25%.

6. A cold rolling, forged steel work roll having high grindability, that work roll having a steel composition that consists, by weight, essentially of:

C: 0.70–1.20%, Si: 0.15–1.00%, Mn: 015–100%,

Cr: 1.5–5.5%, Mo: not greater than 0.60%,

Ti: is present, in a content not greater than 0.0029%,

V: 0.15–0.25%

Ni: 0–1.0%

Fe and incidental impurities: balance.

7. A cold rolling work roll as set forth in claim 6 wherein the maximum particle size is 0.80 μm.

8. A cold rolling work roll as set forth in claim 6 wherein the carbon content is 0.75–0.95%.

9. A cold rolling work roll as set forth in claim 6 wherein the chromium content is 2.5–5.0%.

10. A cold rolling work roll as set forth in claim 1 wherein nickel is present, in a content of 1.0% or less.

11. A cold rolling work roll as set forth in claim 6, wherein the vanadium content is 0.16–0.35%.

12. A cold rolling work roll as set forth in claim 1, wherein the V content is 0.15–0.25%.

* * * * *

UNITED STATES PATENT AND TRADEMARK OFFICE

CERTIFICATE OF CORRECTION

PATENT NO. : 5,505,682
DATED : April 9, 1996
INVENTOR(S) : Shimizu et al

It is certified that errors appears in the above-identified patent and that said Letters Patent is hereby corrected as shown below:

IN THE CLAIMS:

Column 7,

In claim 1, at line 4, after "Mn:" delete "015-100%." and insert

--0.15-1.00%--.

Column 8,

In claim 6, at line 4, after "Mn:" delete "015-100%" and insert

--0.15-1.00%--.

Signed and Sealed this

Twenty-third Day of July, 1996

*Attest:*

Bruce Lehman

BRUCE LEHMAN

*Attesting Officer*

*Commissioner of Patents and Trademarks*